US006571860B2

(12) United States Patent
Hunter et al.

(10) Patent No.: US 6,571,860 B2
(45) Date of Patent: Jun. 3, 2003

(54) TWO TIERED LINEAR MOLD HANDLING SYSTEMS

(75) Inventors: William A. Hunter, Naples, FL (US); William G. Hunter, North Barrington, IL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 0 days.

(21) Appl. No.: 10/054,524

(22) Filed: Jan. 22, 2002

(65) Prior Publication Data

US 2002/0060060 A1 May 23, 2002

Related U.S. Application Data

(63) Continuation-in-part of application No. 09/663,083, filed on Sep. 15, 2000, now abandoned, which is a continuation of application No. 09/168,628, filed on Oct. 8, 1998, now Pat. No. 6,145,577, which is a continuation-in-part of application No. 08/783,647, filed on Jan. 15, 1997, now Pat. No. 5,901,774.

(51) Int. Cl.[7] ..... B22D 5/04; B22D 47/02

(52) U.S. Cl. ..... 164/130; 164/323; 164/324; 164/329; 164/167; 164/339

(58) Field of Search ..... 164/130, 323, 164/324, 329, 167, 339

(56) References Cited

U.S. PATENT DOCUMENTS

| | | | | |
|---|---|---|---|---|
| 671,137 A | | 4/1901 | Johnston | |
| 783,200 A | | 2/1905 | Henderson | |
| 2,956,319 A | | 10/1960 | Deakins et al. | 164/324 |
| 3,029,482 A | | 4/1962 | Burnett | |
| 3,068,537 A | | 12/1962 | Fellows | 164/324 |
| 3,083,421 A | | 4/1963 | Taccone | 164/324 |
| 3,123,871 A | | 3/1964 | Taccone | 164/324 |
| 3,576,246 A | | 4/1971 | Hulet et al. | 198/19 |
| 3,605,869 A | | 9/1971 | Chapman et al. | 164/324 |
| 3,612,159 A | * | 10/1971 | Galinsky | 164/324 |
| 3,682,236 A | | 8/1972 | Becke | 164/324 |

(List continued on next page.)

FOREIGN PATENT DOCUMENTS

| | | | |
|---|---|---|---|
| DE | 1236140 | 3/1967 | 164/324 |
| DE | 3121268 | 12/1982 | 164/324 |
| GB | 632104 | 11/1949 | 164/324 |
| JP | 59-24570 | 2/1984 | 164/324 |
| RU | 737113 | 5/1980 | 164/324 |
| RU | 869963 | 10/1981 | 164/323 |
| RU | 1731430 | 5/1992 | 164/324 |

OTHER PUBLICATIONS

Drawing No. 1, Cooling Conveyor Assembly, Gaylord Foundry Equipment, Inc., dated May 11, 1983 and Sep. 22, 1982 (see also Supplemental Statement).

Drawing No. 2, Mold Handling System General Arrangement, Roberts Sinto Corporation, dated Mar. 5, 1998 (see also Supplemental Statement).

*Primary Examiner*—Tom Dunn
*Assistant Examiner*—I.-H. Lin
(74) *Attorney, Agent, or Firm*—Leydig, Voit & Mayer, Ltd.

(57) ABSTRACT

A two tiered mold handling system for use in a sand mold casting machine which comprises a two tiered conveyor for pouring and cooling, or a two tiered conveyor for cooling only. The two-tiered conveyor has an upper linear track and a lower linear track disposed at a lower vertical elevation. The tracks carry a plurality of mold pallets along an endless path around the upper and lower linear tracks. The application is directed toward several concepts including two tiered pouring conveyors in combination with two tiered cooling conveyors, two tiered combination pouring and cooling conveyors, and one tiered pouring conveyors in combination with two tiered cooling conveyors to provide a lower pouring elevation.

20 Claims, 12 Drawing Sheets

U.S. PATENT DOCUMENTS

| | | | | | |
|---|---|---|---|---|---|
| 3,743,004 | A | | 7/1973 | Becke | 164/18 |
| 3,821,978 | A | | 7/1974 | Kauffman | 164/323 |
| 3,955,613 | A | | 5/1976 | Lund | 164/130 |
| 3,989,094 | A | | 11/1976 | Gorenflo et al. | 164/324 |
| 4,040,525 | A | | 8/1977 | Tokunaga et al. | 214/6 P |
| 4,105,060 | A | | 8/1978 | Hauke | 164/130 |
| 4,224,979 | A | | 9/1980 | Rosin et al. | 164/130 |
| 4,299,269 | A | | 11/1981 | Friesen et al. | 164/324 |
| 4,422,495 | A | | 12/1983 | Van Nette, III | 164/324 |
| 4,438,801 | A | | 3/1984 | Buhler | 164/130 |
| 4,585,049 | A | * | 4/1986 | Sitta et al. | 164/324 |
| 4,589,467 | A | | 5/1986 | Hunter | 164/326 |
| 4,747,444 | A | | 5/1988 | Wasem et al. | 164/457 |
| 4,995,769 | A | | 2/1991 | Berger et al. | 414/403 |
| 5,022,512 | A | | 6/1991 | Hunter | 198/718 |
| 5,062,465 | A | | 11/1991 | Mortensen | 164/4.1 |
| 5,063,987 | A | | 11/1991 | Weimann | 164/324 |
| 6,145,577 | A | * | 11/2000 | Hunter et al. | 164/323 |
| 6,263,952 | B1 | * | 7/2001 | Hunter | 164/324 |
| 6,460,600 | B1 | * | 10/2002 | Wuepper et al. | 164/130 |

* cited by examiner

TWO TIERED LINEAR MOLD HANDLING SYSTEMS

CROSS-REFERENCE TO RELATED PATENT APPLICATIONS

This is continuation-in-part of U.S. patent application Ser. No. 09/663,083, filed Sep. 15, 2000 entitled linear mold handling system and now abandoned, which is a continuation of U.S. patent application Ser. No. 09/168,628 filed Oct. 8, 1998 entitled LINEAR MOLD HANDLING SYSTEM, now U.S. Pat. No. 6,145,577, which is a continuation-in-part application of U.S. patent application Ser. No. 08/783,647 filed on Jan. 15, 1997, entitled LINEAR MOLD HANDLING SYSTEM WITH DOUBLE-DECK POURING AND COOLING LINES, now U.S. Pat. No. 5,901,774. The entire disclosure of these patent applications and patents are hereby incorporated by reference in their entireties.

FIELD OF THE INVENTION

The present invention generally relates to mold handling systems, and more particularly relates to sand mold handling systems.

BACKGROUND OF THE INVENTION

Molded metal castings are commonly manufactured at foundries through a matchplate molding technique which employs green sand molds comprised of prepared sand and additives which are compressed around cope and drag patterns mounted on opposite sides of a matchplate. The sand mold is thus formed in upper and lower matching portions, an upper cope mold, and a lower drag mold. The cope mold is formed in a separate cope flask which is filled with prepared sand and compacted onto the matchplate. The matchplate is then removed leaving an indentation in the cope mold of the desired shape for the upper portion of the casting. Simultaneously, the drag mold is formed in a separate drag flask. Usually the matchplate is in the form of a planar member with the pattern for the cope mold on one side and the pattern for the drag mold on the other. After the cope and drag molds have been formed, they are placed together to form a unitary mold having an interior cavity of the desired shape. The cavity can then be filled with molten metal through an inlet or "sprue" provided in the cope mold to create the desired casting. Such a system is disclosed in Hunter U.S. Pat. No. 5,022,212.

As with many volume sensitive production operations, manufacturers are required to automate the manufacturing process in order to remain competitive. Foundries engaging in the casting of metal objects through the use of green sand molds are not immune to this reality. It is common in today's marketplace, for the machine which produces the sand molds to be connected to a machine which fills the sand mold with molten metal, which in turn is connected to a machine for cooling the molten metal into a solid casting, which in turn is connected to a machine for removing the sand mold and revealing the casting for harvest. Such a system is disclosed in Hunter U.S. Pat. No. 4,589,467.

In the aforementioned '467 patent, the sand molds are manufactured and communicated along a linear conveyor to a circular, rotating, or "carousel" conveyor. Molten metal is introduced into the molds at one location on the carousel and the molten metal is then allowed to cool within the sand mold as the carousel rotates. The carousel is provided with both an outer diameter track and an inner diameter track which provide for additional cooling of the metal, and which increase the throughput of the machine.

While such a carousel system has enjoyed, and continues to enjoy, considerable commercial success, it is not without its drawbacks. In particular, if a manufacturer wishes to increase the throughput of a carousel-type molding machine, a carousel of a different diameter will necessarily have to be employed, at considerable additional expense. In addition, every time a new carousel is needed, a substantial downtime period is encountered wherein the machine is not producing castings, and which requires considerable labor to put into effect.

Similarly, if the cooling times of the metal being processed through machine are variable, the length of the cooling cycle will accordingly be affected. With a carousel-type conveyor, the cooling cycle time can be increased either by slowing the carousel, or by adding a carousel of a greater diameter. Conversely, if the cooling time is to be lessened, the rotational speed of the carousel can be increased, or a carousel having a smaller diameter can be added. However, both options are less than desirable. If the carousel is slowed, the throughput of the machine is proportionally diminished, and if a new carousel is added, additional expense is incurred due to increased downtime and additional equipment overhead.

U.S. Pat. No. 5,901,774 therefore discloses a linear mold handling system wherein separate double-deck pouring and cooling conveyors are provided. Sand molds are transferred to the pouring conveyor and indexed to a station in which molten metal is deposited into the sand molds. The molten metal filled sand molds are then transferred to a lower level of the pouring conveyor and then back to the upper level of the pouring conveyor before being transferred to a separate cooling conveyor provided laterally adjacent to the pouring conveyor. The embodiment disclosed in the aforementioned parent application provides a cooling conveyor which is three rows wide and includes a plurality of trays adapted to receive up to three molds disposed on the conveyor. The partially cooled sand molds are transferred from the pouring conveyor to the cooling conveyor and into one of the trays disposed thereon. Each tray is adapted to receive up to three sand molds. Once a tray is filled, it is indexed forward until reaching an end of the upper level of the cooling conveyor at which time the elevator lowers the trays to a lower level and then back to an upper level of the cooling conveyor before being pushed into a dump chute and a shake-out vibrating conveyor.

One issue that has arisen and has been discovered by the inventive entity of the present invention is that pouring metal into molds carried on the upper deck of a two tiered conveyor may limit the size of the mold to be used with the two tiered mold handling system. Because a worker manually pours metal into molds from a ladle, system design is thus faced with a limited worker height. Taller molds make it difficult to manually pour molten metal into the molds at higher elevations on the conveyor that is necessitated by the increased height of the molds.

BRIEF SUMMARY OF THE INVENTION

It is an aim of the preferred embodiment of the present invention to provide a linear sand mold handling system with an ability to be tailored to the specific dwell time requirements of the metal being poured.

It is another aim of the present invention to provide a simplified sand mold handling system with reduced equipment requirements and thus reduced cost for both initial start-up and for maintenance over time.

It is an objective of the present invention to provide a linear sand mold handling system with improved volumetric capacity or throughput capability.

It is another objective of the present invention to provide a linear sand mold handling system with more uniform cooling in order to provide more physically reliable and predictable castings.

It is another objective of the present invention to provide for use of two-tiered mold handling systems with larger/taller molds.

Based on the foregoing, the present invention is directed broadly toward a two tiered mold handling system for use in a sand mold casting machine which comprises a two tiered conveyor for pouring and cooling, or two tiered conveyor for cooling only. The two-tiered conveyor has an upper linear track and a lower linear track disposed at a lower vertical elevation. The tracks carry a plurality of mold pallets along an endless path around the upper and lower linear tracks. It is believed that the present invention as claimed ties together several concepts including two tiered pouring conveyors in combination with two tiered cooling conveyors, two tiered combination pouring and cooling conveyors, and one tiered pouring conveyors in combination with two tiered cooling conveyors to provide a lower pouring elevation.

According to one aspect of the present invention, each mold pallet has a plurality of adjacent mold receiving locations such that each mold pallet is adapted to receive at least two sand molds side by side. This provides for parallel movement of molds. Indexing rams may be provided to shift the molds between the different mold receiving locations on each mold pallet.

According to another aspect of the present invention, the two tiered conveyor receives and discharges molds on the top track. It is a feature that a one tiered pouring conveyor may be provided adjacent to the two tiered cooling conveyor but at a lower elevation than the top track of the two tiered cooling conveyor to provide for a lower pouring elevation. An elevator is provided for elevating molds from the one tiered pouring conveyor to the upper track of the two tiered cooling conveyor. It is an advantage that this arrangement allows for indexing or shifting of molds laterally can be done on the top track.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
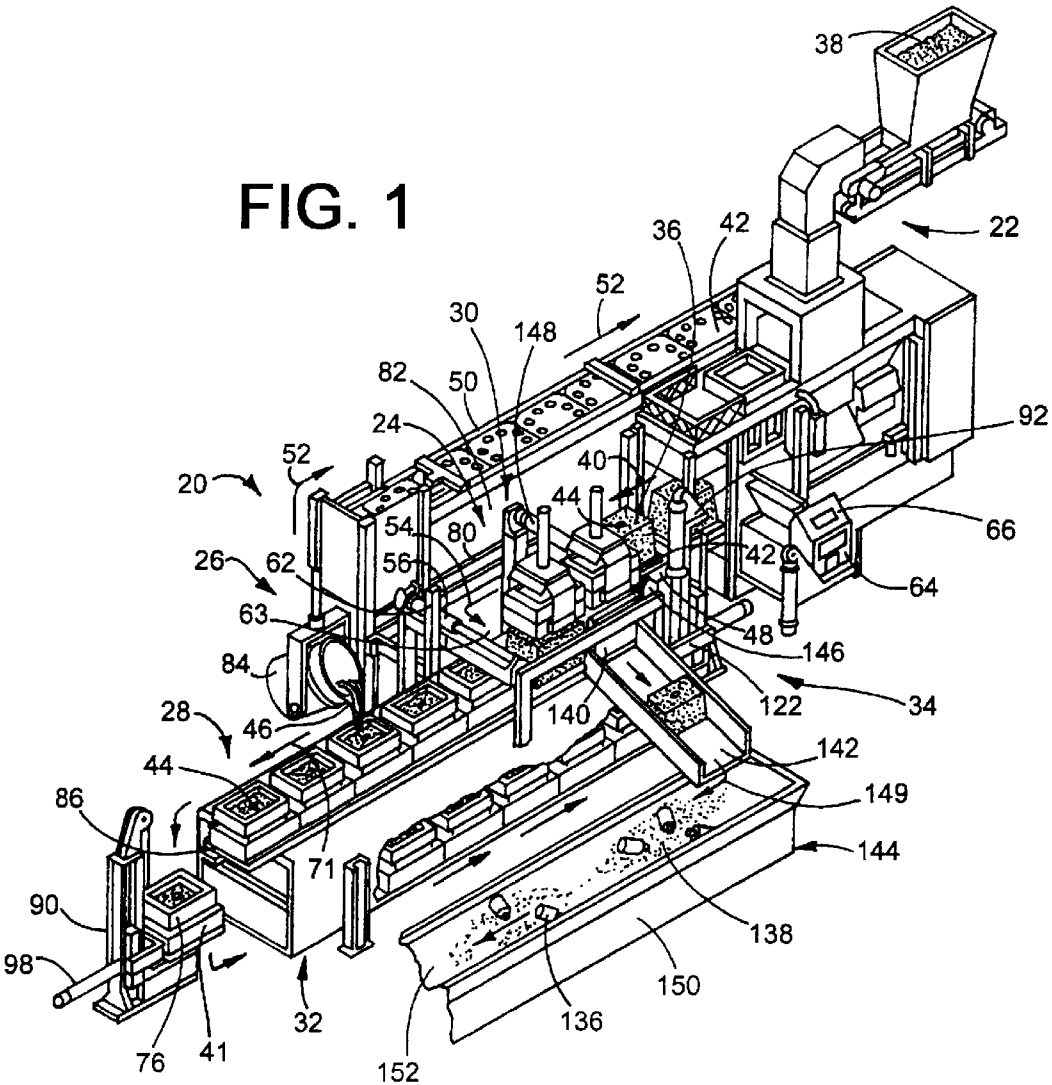
FIG. 1 is a perspective view of the first preferred embodiment of the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Referring now to FIG. 1, the present invention, generally depicted as sand mold handling system 20, is comprised of sand mold forming station 22, weight and jacket installation station 24, pouring station 26, mold handling conveyor 28, weight and jack removal station 30, and discharge station 34. As depicted by the directional arrows shown in FIG. 1, the motion of sand mold 36 from start to finish, defines a linear flow path, the importance of which will be discussed in further detail. It is important to note from FIG. 1 that a first embodiment of the present invention is depicted and that other embodiments are disclosed herein. Moreover, while the disclosed embodiments are related to parent application Ser. No. 08/783,647, now U.S. Pat. No. 5,901,774, the embodiments of FIGS. 1–7 disclosed herein do not include separate pouring and cooling conveyors, but rather have a single conveyor of variable width across which pallets of variable width traverse, and on which the pouring and cooling operations occur.

Although the present invention is directed toward the mold handling system, for completeness and clarity of function the machine depicted in FIG. 1 also shows a sand mold forming station 22 which produces sand molds 36. It is to be understood that sand mold forming station 22 is of a conventional matchplate forming design in which sand 38 is compressed within a flask about a matchplate. The sand mold is typically formed from two portions (not shown), an upper cope mold, and a lower drag mold. One cope mold and one drag mold are combined to form a unitary sand mold 36 comprised of compressed sand and having an internal cavity of the desired shape for the casting. Those of ordinary skill in the art will understand that cores can be inserted into the cavity so as to form internal apertures within the resulting castings. Such cores are also typically formed from compressed sand. Such a process is described in the aforementioned Hunter U.S. Pat. No. 5,022,512, the disclosure of which is expressly incorporated by reference herein.

As shown in FIG. 1, sand molds 36 exit from sand mold forming station 22 in the direction depicted by arrow 40. Sand molds 36 exit station 22 on bottom boards 42, and are provided with inlets, or sprues, 44 for the entrance of molten metal 46. Shuttle conveyor 48 is provided to transport sand molds 36 from sand mold forming station 22 to weight and jacket installation station 24. Bottom board return conveyor 50 is provided to transport bottom boards 42 back to sand mold forming station 22 in the direction depicted by arrows 52 after molds 36 are pushed from bottom boards 42 on to pouring pallets 37 at the weight and jacket installation station 24. In the preferred embodiment pouring pallet 37 is manufactured from cast iron.

Figure 2:
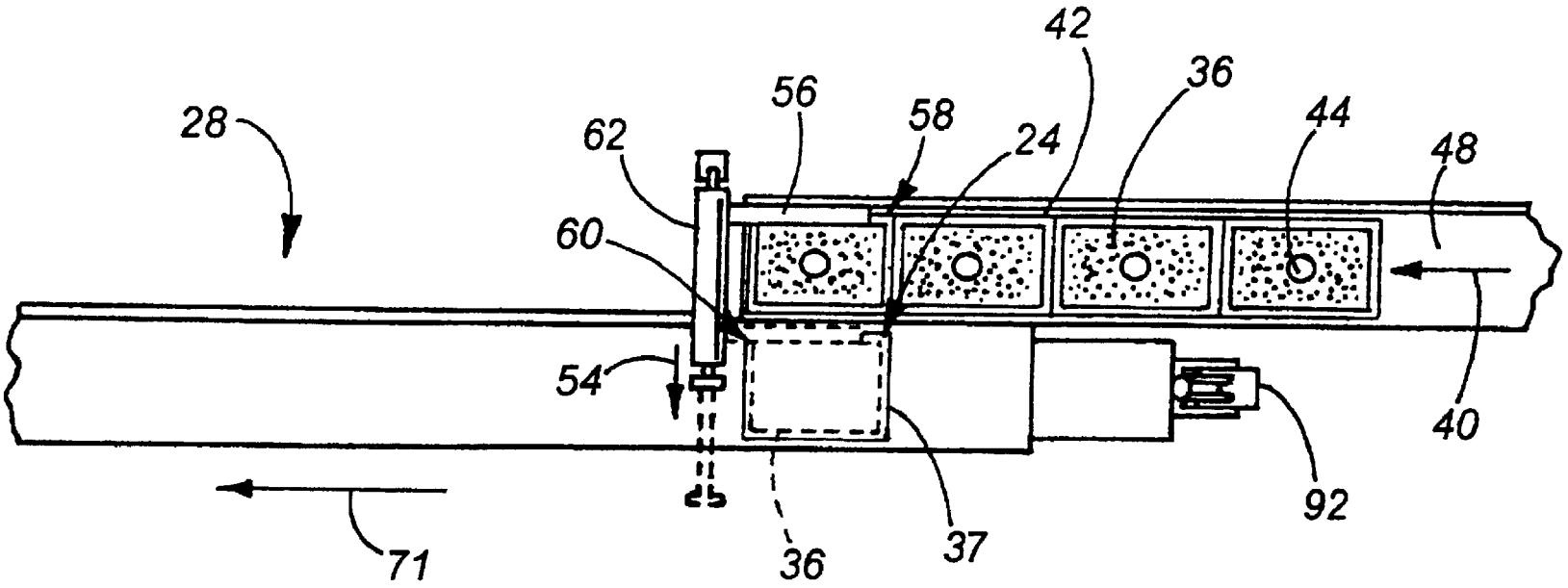
FIG. 2 is a schematic view of the transfer of sand molds from the shuttle conveyor to the first row of the mold handling conveyor.

With specific reference to the first preferred embodiment of the present invention, it can be seen that upon reaching the end of shuttle conveyor 48, sand molds 36 are moved from shuttle conveyor 48 to mold handling conveyor 28 having a width sufficient to accommodate a single row of sand molds 36. More specifically, conveyor 28 has a width sufficient to accommodate pouring pallets 37 adapted to hold a single mold 36. Upon being transferred to conveyor 28 and pallets 37, sand mold 36 is at weight and jacket installation station 24. This motion is in the direction depicted by arrow 54. Weight and jacket installation station 24 is located along upper track 86 (FIG. 3) of conveyor 28. As shown in FIG. 2, this motion is accomplished through the use of pusher arm 56 which is indexable between position 58 and position 60 shown in shadow. Pusher arm 56 is powered by pneumatic or hydraulic ram 62 which is of a simple and conventional design. Pusher arm 56 includes a substantially rectangular flap which engages sand molds 36.

Figure 3:
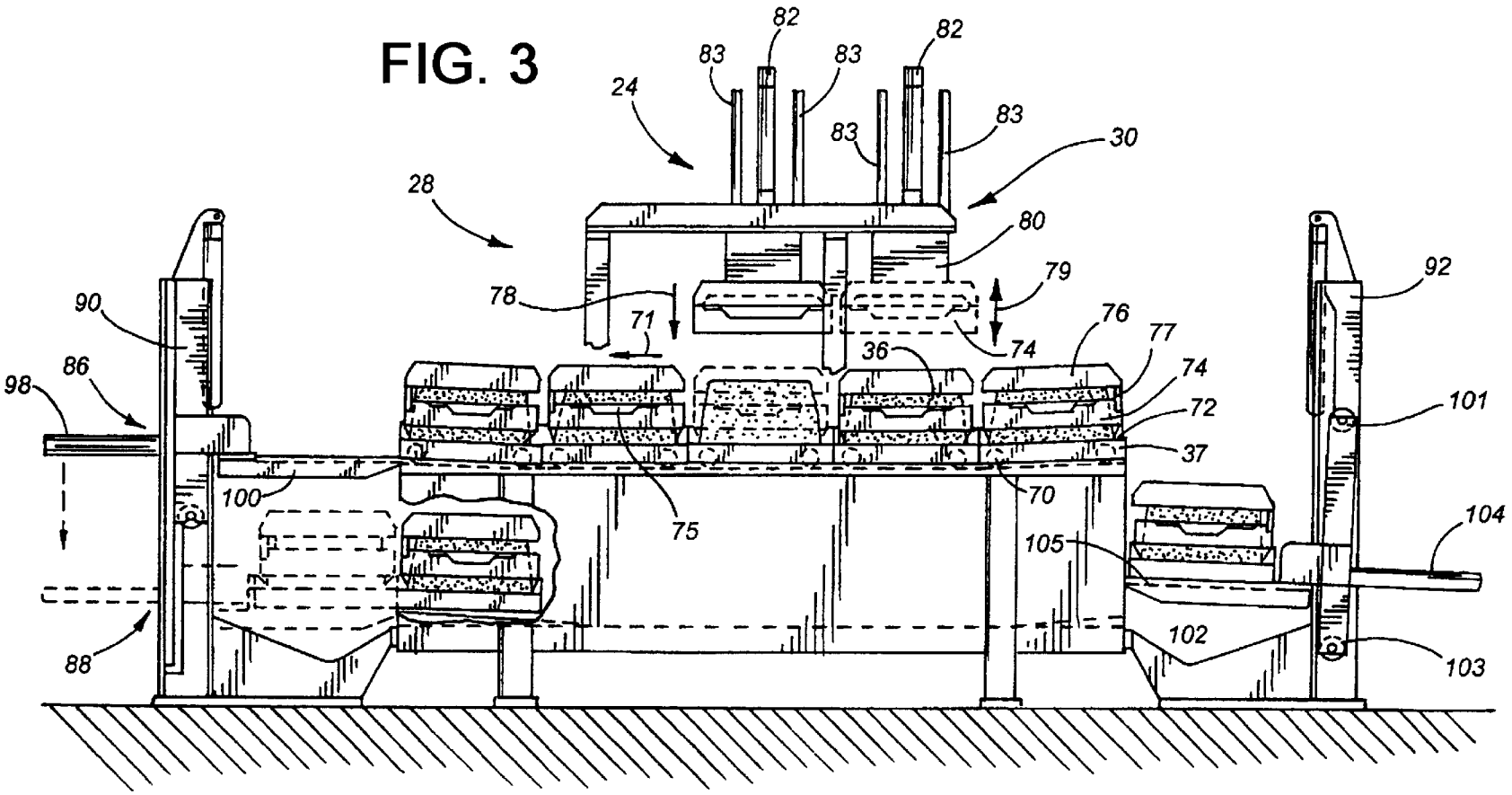
FIG. 3 is a side view of the mold handling conveyor.
Figure 4:
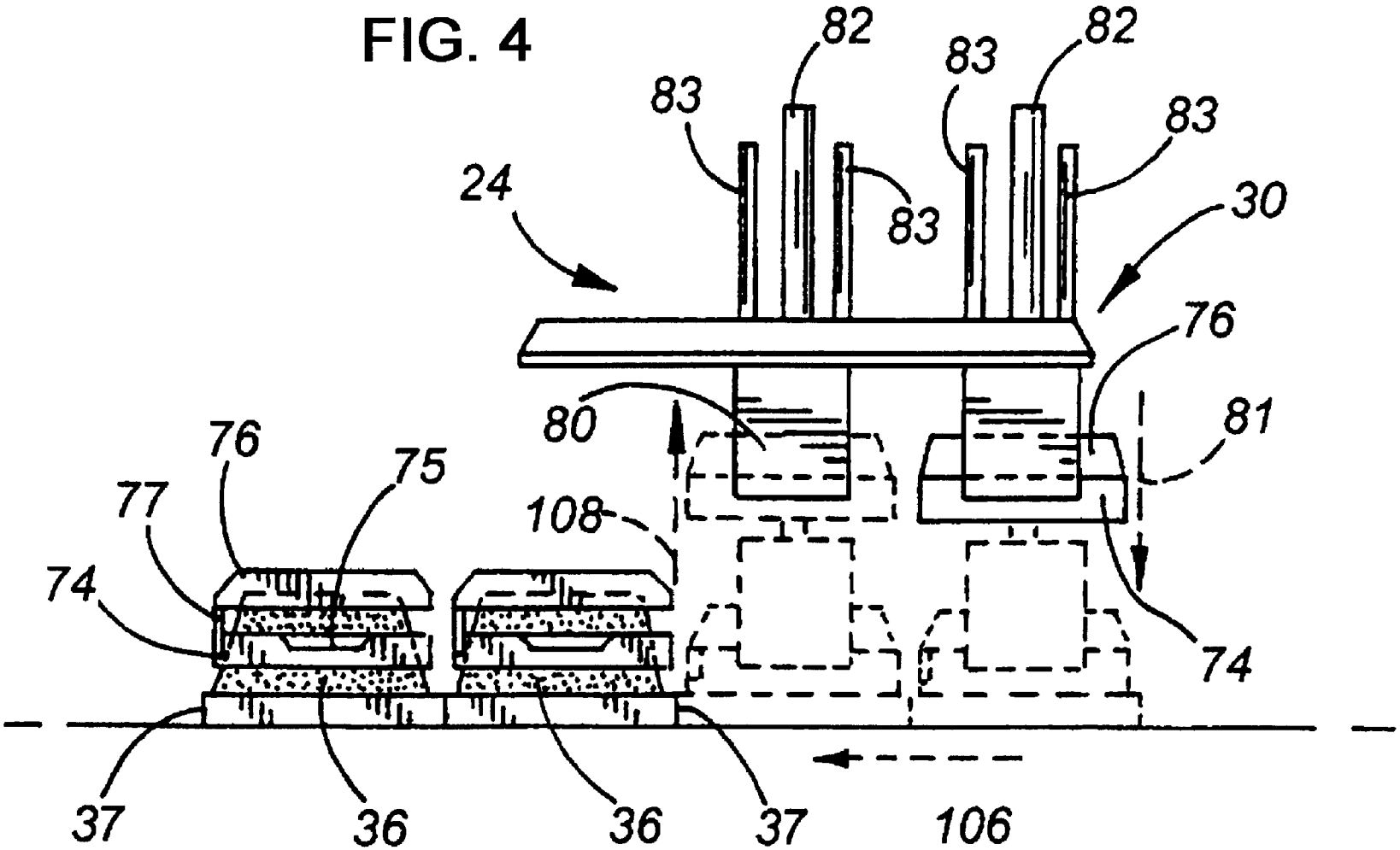
FIG. 4 is a schematic view depicting the movement of a weight and jacket set after being removed, placed back on to the mold handling conveyor, indexed to the weight and jacket installation station and raised for installation onto a new sand mold.

Sand molds 36 are moved from bottom boards 42 to pouring pallets 37 at weight and jacket installation station 24. As best shown in FIG. 3, pouring pallets 37 are provided with casters 70 to provide locomotion to sand molds 36, and raised corners to align with jacket 74 as will be described with further detail herein. After being placed on pouring pallet 37, jacket 74 is installed around the middle of sand mold 36, and weight 76 is placed on top of sand mold 36 as shown in FIG. 4. In the preferred embodiment, weights 76 include guide pins 77 to align weights 76 with jackets 74. The sides of sand mold 36 are slanted to facilitate this installation.

The installation of jacket 74 and weight 76 are best depicted in FIG. 3 wherein the motion of jacket 74 and weight 76 as they are being placed onto sand molds 36 is depicted by arrow 78. Gripper arms 80 are provided to grasp and release jacket 74 and weight 76 through frictional, magnetic, or other methods. Gripper arms 80 are adapted to move up and down along main shaft 82, and auxiliary rods 83. In the preferred embodiment, gripper arms 80 are provided with hooks which engage ledges 75 provided on jackets 74.

From weight and jacket installation station 24, sand molds 36, equipped with jacket 74 and weight 76, proceed to pouring station 26 along upper track 86 of conveyor 28 in the direction of arrow 71. As depicted in FIG. 1, it is at pouring station 26, that molten metal 46 is introduced into sand molds 36 through sprue 44. In the embodiment depicted in FIG. 1, molten metal 46 is manually introduced into sand molds 36 from supply 84, although automated mechanisms for such action are certainly possible. In the preferred embodiment, vat 84 is mounted on an overhead track (not shown) which allows vat 84 to be manually transported from a source of molten metal to pouring station 26. It is to be understood that although pouring station 26 is shown in a specific location, pouring station 26 may be moved to a number of positions along mold handling conveyor 28.

Referring now to FIG. 3, conveyor 28 is shown in detail. It is conveyor 28 which transports sand molds 36 and pallets 37 from weight and jacket installation station 24 to pouring station 26, and ultimately to weight and jacket removal station 30 in a continuous loop. Conveyor 28 is comprised of upper track 86 and lower track 88 wherein communication between upper track 86 and lower track 88 is accomplished by elevator 90 and communication between lower track 88 and upper track 86 is accomplished through elevator 92. It is important to note that conveyor 28 is not a "conveyor" in the traditional sense in that it does not include any internal driving mechanism, but rather is comprised of rails along which pouring pallets 37 having casters 70 are pushed via hydraulic rams 98 and 104 provided on elevators 90 and 92, respectively.

As shown in FIG. 2, each pouring pallet 37 is in engagement with other pouring pallets 37 situated both fore and aft. Elevators 90 and 92 not only provide motion between upper track 86 and lower track 88, and vice versa, but also provide locomotion along upper track 86 and lower track 88 through the use of rams 98 and 104. As shown in FIG. 2, after elevator 90 moves sand mold 36 from upper track 86 to a position adjacent lower track 88 (shown in dashed lines), ram 98 pushes sand mold 36 from platform 100 to lower track 88. The force of this motion directs sand mold 38 onto lower track 88, and by engaging the other sand molds 36 on lower track 88, pushes the other sand molds 36, and ultimately pushes one sand mold 36 onto platform 102 of the second elevator 92. Elevator 92 then lifts sand mold 36 to upper track 86, and through the use of ram 104 pushes sand mold 36 onto upper track 86. Therefore, it can be seen that conveyor 28 is comprised of a multiple, yet discrete, number of positions and sand molds 36 are indexed serially from one position to the next. As best shown by elevator 92 shown in FIG. 2, the elevators of the present invention are adapted to tilt backward to allow sufficient clearance during each lift. Upper pivot 101 and lower pivot 103 cooperate to tilt platform 102 so that front lip 105 of platform 102 is raised to a height sufficient to clear upper track 86 and lower track 88. This arrangement substantially eliminates the possibility of pouring pallet 37 not being raised to a sufficient height and thereby engaging the end of each track and preventing movement of the baseplate from the pallet and to the upper and lower tracks.

It is to be understood that as molten metal 46 is introduced into sand castings 36 at pouring station 26, molten metal 46 immediately begins to cool. As sand molds 36 traverse conveyor 28, molten metal 46 continually cools to a semi-solid state. Therefore, depending on the particular metal being poured, upon reaching weight and jacket removal station 30, weights 76 and jackets 74 can be removed as depicted in FIG. 3 without molten metal 46 affecting the integrity of sand mold 36. The removed jacket 74 and weight 76 are then placed back on pouring pallet 37 and indexed to weight and jacket installation station 24 in the direction depicted by arrows 106 and shown in FIG. 4. As alluded to earlier, raised corners 72 of pouring pallets 37 are used to align jackets 74 on top of pouring pallets 37. At weight and jacket installation station 24, gripper arms 80 again grasp jacket 74 and weight 76 and lift them upward along shaft 82 as best shown in FIG. 4 by directional arrow 108. After jacket 74 and weight 76 have been lifted at weight and jacket installation station 24 to the position shown in FIG. 4, a newly formed sand mold 36 is pushed onto pouring pallet 37 by pusher arm 56 as discussed earlier and as depicted in FIG. 2.

As shown in FIG. 3, at weight and jacket removal station 30, gripper arms 80 move downward in the direction of arrow 79 to grip the weights and jackets and then upward to lift the weights and jackets off sand mold 36. It is at this point in the sequence of operation that the different embodiments of the present invention are set apart. As stated earlier, depending on the particular metal being poured, different cooling or dwell times will be required before the metal actually hardens to allow the sand to be removed from the casting. With certain metals and mold shapes, a conveyor 28 of a single row width such as that shown in FIG. 1 will be sufficient to enable the casting to be fully hardened by the time it navigates the upper track and lower track of conveyor 28. With other metals and shapes, however, additional cooling time will be required, and the second and third embodiments of the present invention, as well as the embodiment shown in the parent application are provided to satisfy the additional cooling time requirements. As opposed to the embodiment disclosed in the parent applications which uses completely separate pouring and cooling lines, and associated hardware, the present invention provides mechanisms for adjusting cooling time while using and maintaining a single line and thus one set of hardware including elevators.

Figure 5:
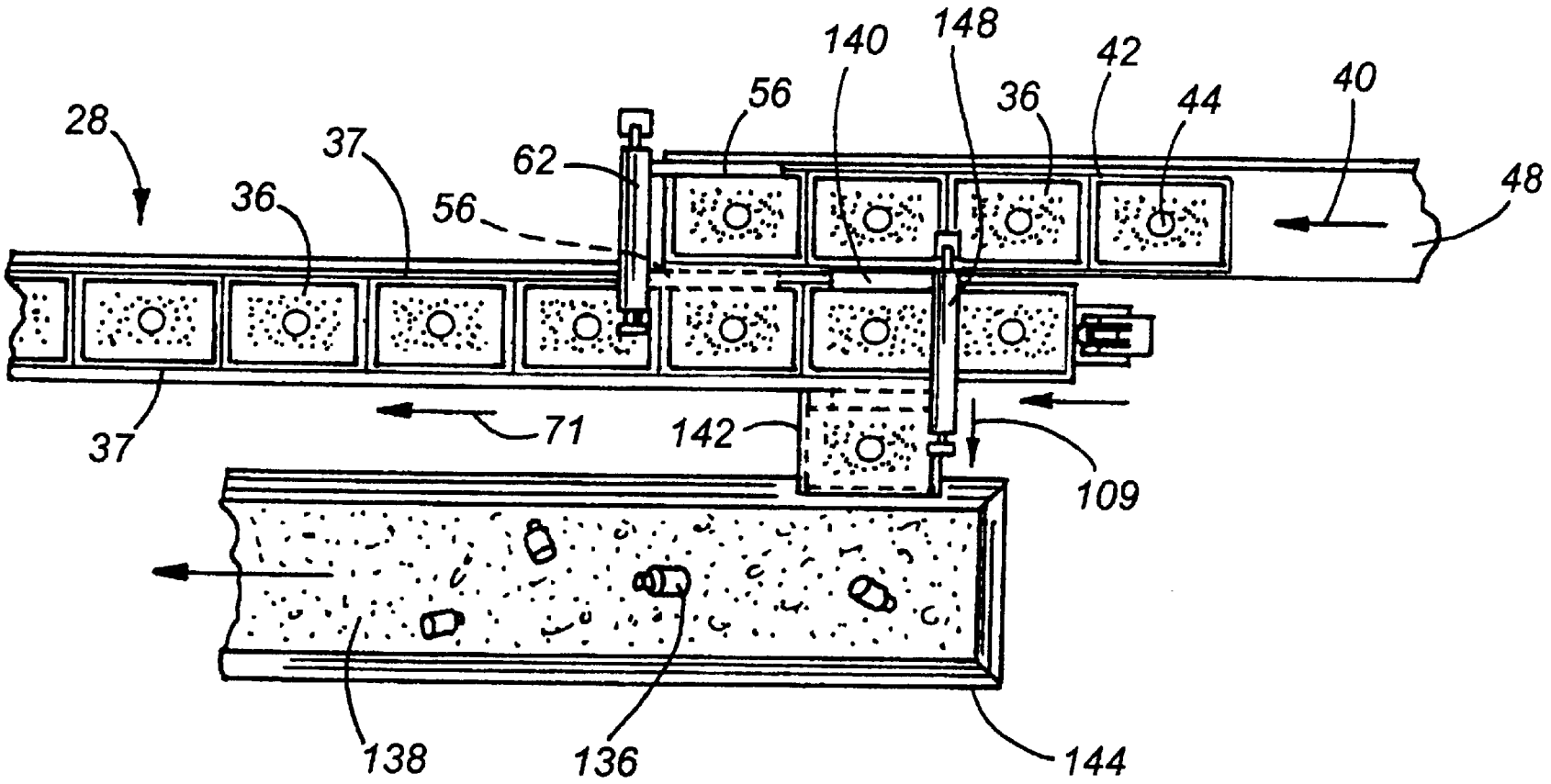
FIG. 5 is a schematic plan view showing removal of a cooled sand mold from the mold handling conveyor and onto the shake-out conveyor.

Before turning to the second and third embodiments, it can be seen in FIG. 5 that in the first embodiment of the present invention additional rows for cooling purposes are not provided and that upon reaching weight and jacket removal station 30, the metal is sufficiently cooled to allow the sand to be removed. To accomplish this, it can be seen in FIGS. 1 and 5 that a dump chute 142 is provided leading to shake-out conveyor 144.

In order to remove sand molds 36 from conveyor 28, a second hydraulically actuated pusher arm 140 is provided as best shown in FIG. 5. Pusher arm 140 is adapted for hydraulic movement by a ram 148 along beam 146 as shown in FIG. 1. Upon reaching dump chute 142, sand molds 36 fall to shake-out conveyor 144 through the effects of gravity as depicted by arrow 149. The force of this downward movement causes sand molds 36 to contact shake-out conveyor 144, which in turn causes residue 138 to fall away from castings 136. Shake-out conveyor 144 is provided to facilitate removal of sand residue 138 for recycling thereof and for removing castings 136 for harvest.

Figure 6:
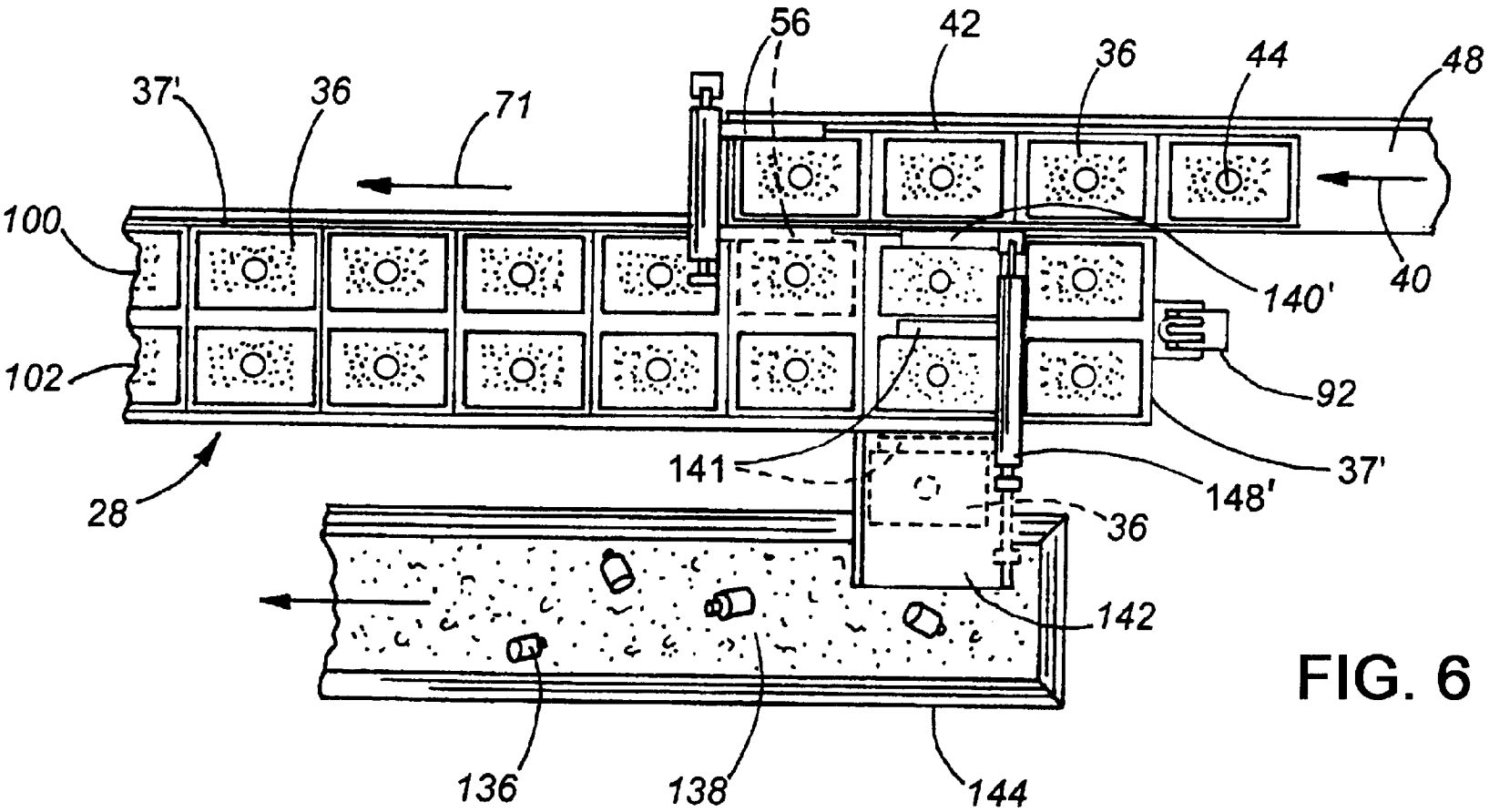
FIG. 6 is a schematic plan view of a second preferred embodiment of the present invention having a mold handling conveyor two rows wide.
Figure 7:
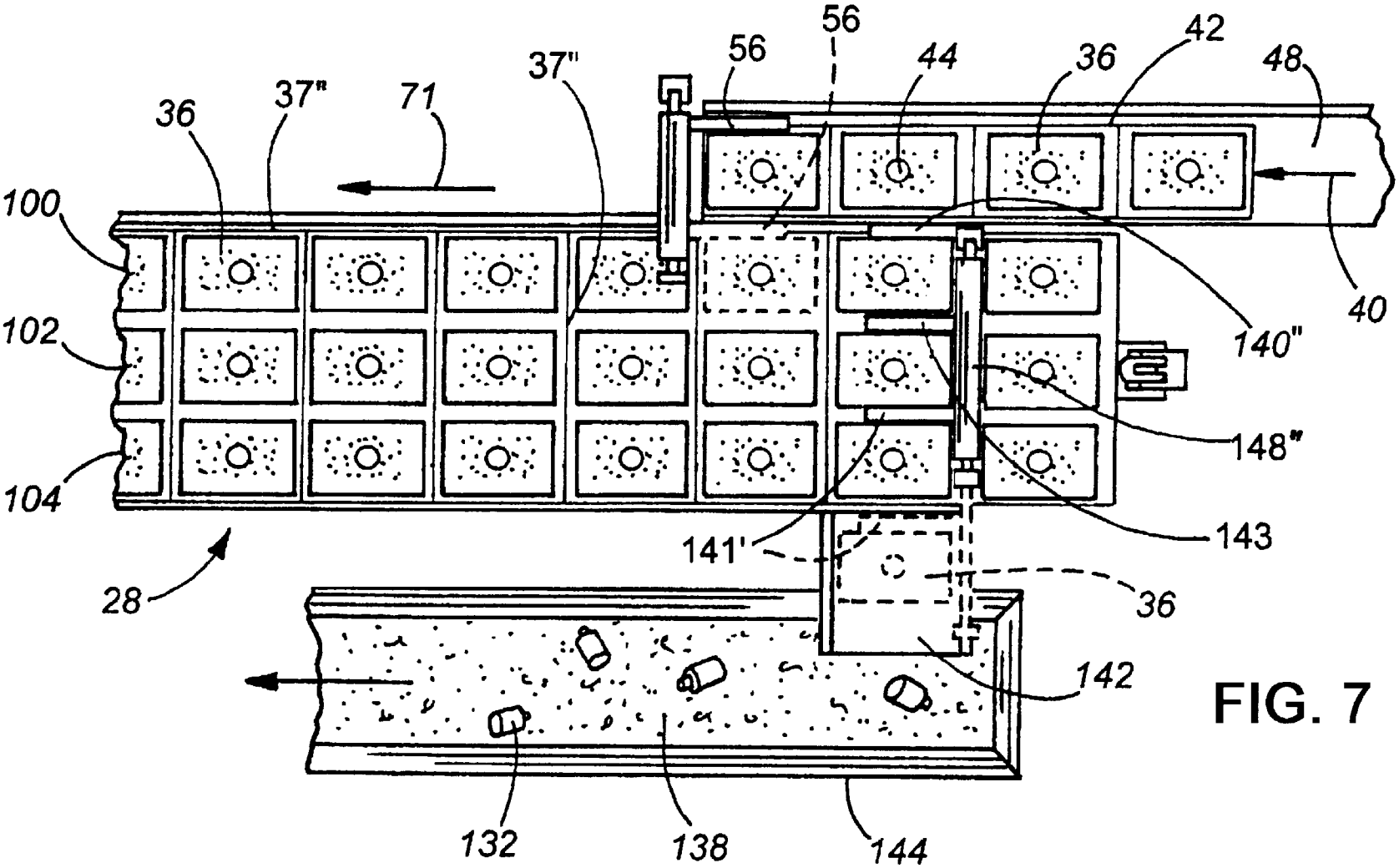
FIG. 7 is a schematic plan view of a third preferred embodiment of the present invention having a mold handling conveyor three rows wide.

As stated earlier, additional cooling time may be required depending on the particular metal being poured. The second and third embodiments of the present invention are therefore provided as best shown in FIGS. 6 and 7, respectively. Operation of the embodiments is substantially the same as the first embodiment, but as can be seen from the figures, the second embodiment provides a wider mold handling conveyor 28, while the third embodiment provides an even wider mold handling conveyor 28. In conjunction therewith, the second embodiment employs a pouring and cooling pallet 37' wide enough to accommodate two molds 36, while the third embodiment using a pouring and cooling pallet 37" wide enough to accommodate three molds 36.

With specific reference to the second embodiment, attention is now drawn to FIG. 6 wherein pouring and cooling pallet 37' and conveyor 28 includes first row 100 and second row 102. Transfer of sand molds 36 from shuttle conveyor 48 to mold handling conveyor 28 is identically the same, as is the installation of weights 76 and jackets 74. Sand molds 36 traverse along conveyor 28 to pouring station 26, move from upper track 86 to lower track 88 in the identical manner, and are moved from lower track 88 to upper track 86 in the identical manner as the first embodiment using elevators 90 and 92, respectively.

However, upon jackets 74 and weights 76 being removed from sand mold 36, the second embodiment departs from the first embodiment, in that rather than being pushed down dump chute 142, sand molds 36 are indexed over to second row 102 via pusher arm 140 to provide additional cooling time. In other words, rather than having sand residue 138 removed from a semi-cooled casting, a second revolution on conveyor 28 is provided through the use of second row 102. To facilitate the pushing action, pallet 37' is lined with graphite in the preferred embodiment, but any surface with a reduced co-efficient of friction can be employed. When pusher arm 140' pushes one sand mold 36 to second row 102, a second pusher arm 141, attached to the same hydraulic ram 148', simultaneously pushes another mold 36 from the second row 102 to shake-out conveyor 144. This unique dual-head design minimizes the number of required hydraulic rams, while preventing one mold 36 from being pushed directly against an adjacent mold.

Similarly, if the particular metal or shape being poured requires an even longer cooling time, the third embodiment shown in FIG. 7 can be employed wherein a third row 104 is added to pouring and cooling pallet 37". Upon completing the second revolution on mold handling conveyor 28 along row 102, a third pusher arm 143 can be used to index molds 36 to third row 104. Then, upon completion of the third revolution through row 104, pusher arm 141' can be used to push sand molds 36 down dump chute 142 and to shake-out conveyor 144. A single hydraulic ram 148" is used to power all three pusher arms. It should be noted that with both the second and the third embodiments, while the width of conveyor 28 is varied, a single elevator is used at each end of conveyor 28. Separate pouring and cooling conveyors are not provided as is shown in the parent application. A substantial cost savings is thereby achieved.

In operation, the present invention provides a mold handling system wherein the travel of the individual sand molds 36 is substantially linear to more easily allow for an adjustable throughput volume and a more variable cooling cycle as opposed to carousel systems, wherein potential volume is limited by the diameter of the carousel, and which can only be adjusted by replacing the carousel with another unit of a different diameter. In contrast, the throughput of the present invention can be more easily adjusted simply by adjusting the width of mold handling conveyor 28 and pallet 37.

Another significant advantage of the present invention is the simplified handling of weights 76 and jackets 74, as well as the very limited number of weights and jackets actually needed to operate the entire system. As best shown in FIG. 1, weights 76 and jackets 74 are removed from sand molds 36 before the molds are indexed to another row or dumped for harvest. The weights and jackets therefore are only used at a single row of conveyor 28, which therefore limits the number of weights and jackets required for the whole system. This necessarily reduces the cost of the mold handling system 20.

In addition, since the present invention is numerically controlled via control 64, and is capable of dynamic modification through operator input module 66, the dwell time or cooling time of the metal within each sand mold 36 is also adjustable. The speed with which sand molds 36 are generated from sand mold forming station 22 is adjustable, as is the speed of mold handling conveyor 28. Since each of these functions is centrally controlled as are the movements of pusher arms, the parameters of the entire system 20 can be uniformly increased and decreased.

From the foregoing, it will be appreciated that the present invention brings to the art a new and improved sand mold handling system wherein the volume of molds capable of being processed, and the cooling time of the sand molds are more adjustable. When an increased cooling time is required, a mold handling system of greater width can be employed. Similarly, when it is desired for the cooling time to be decreased, a narrower mold handling conveyor can be used. By controlling the width of the conveyor, the cooling of the castings is more exactly attained, and thus the yield of the overall system is more reliable. Moreover, rather than using separate pouring and cooling conveyors with separate elevators and associated hardware, the present invention is simplified in that a single conveyor is used with a single set of conveyors and associated hardware. A single hydraulic ram with multiple pusher arms or heads is used to further simplify the system and minimize cost, while still enabling cooling dwell time to be adjustable.

Figure 8:
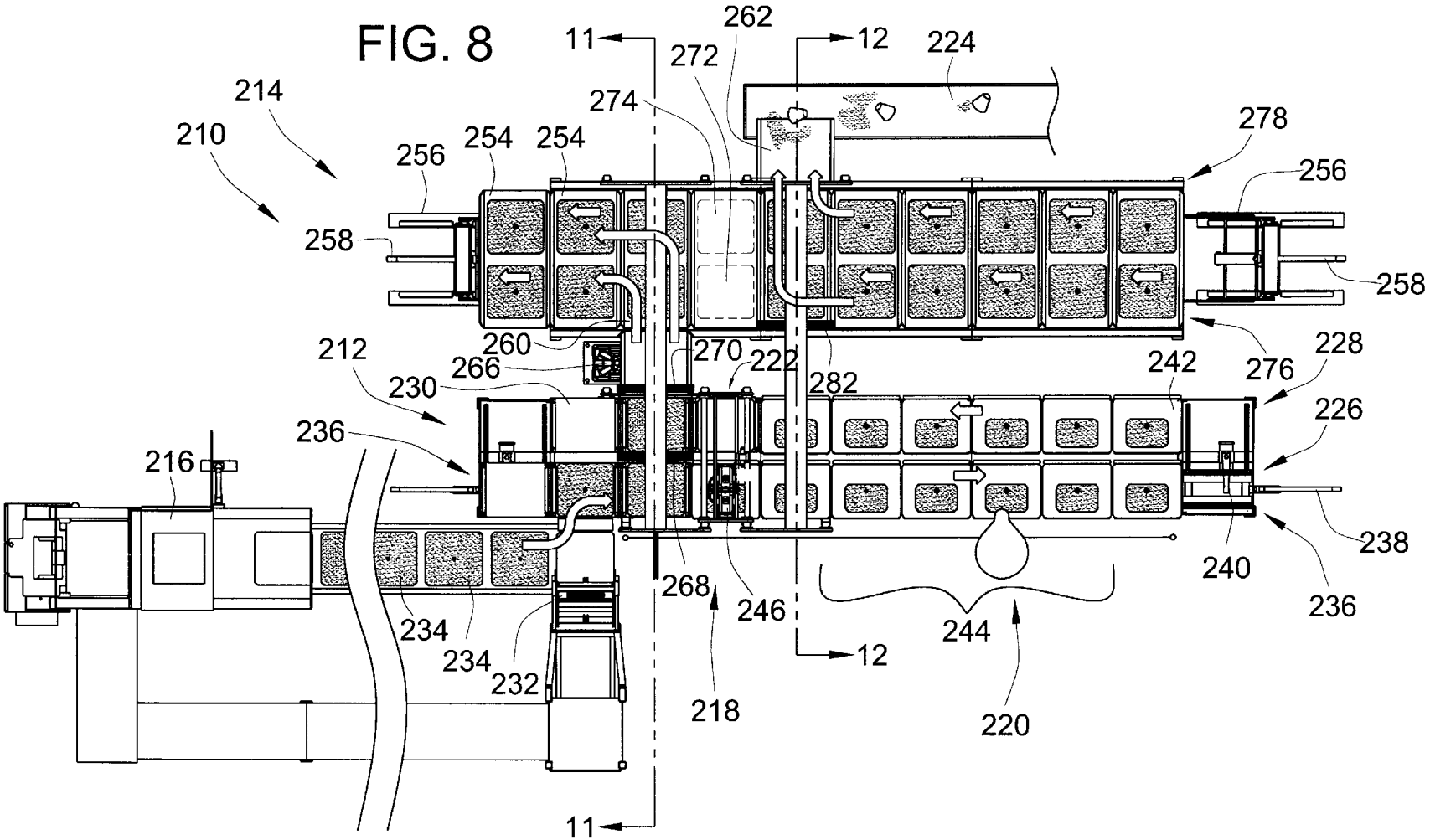
FIG. 8 is a plan view of a mold handling system comprising a one tiered pouring conveyor in combination with a two tiered cooling conveyor, in accordance with a fourth embodiment of the present invention.

A fourth embodiment of the present invention is illustrated in FIGS. 8–12. As shown therein, a mold handling system 210 comprises a one tiered pouring conveyor 212 adjacent a separate two tiered cooling conveyor 214. FIG. 8 illustrates the particular arrangement of the system 210 that includes a sand mold forming station 216, a weight and jacket installation station 218, a pouring station 220, a weight and jacket removal station 222 and a discharge conveyor 224.

Figure 10:
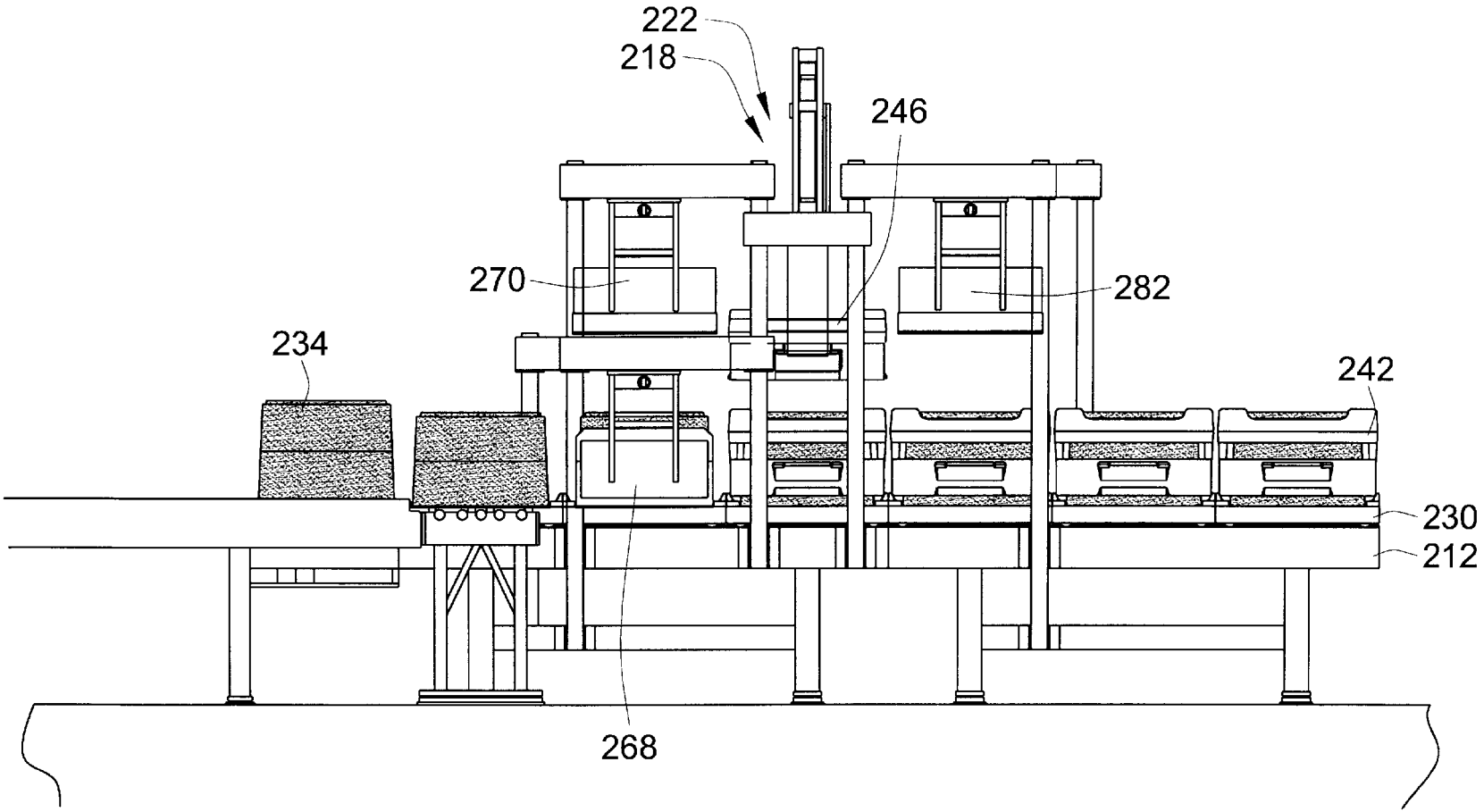
FIG. 10 is an enlarged view of a portion of the pouring conveyor of FIG. 9 with the cooling conveyor removed.
Figure 11:
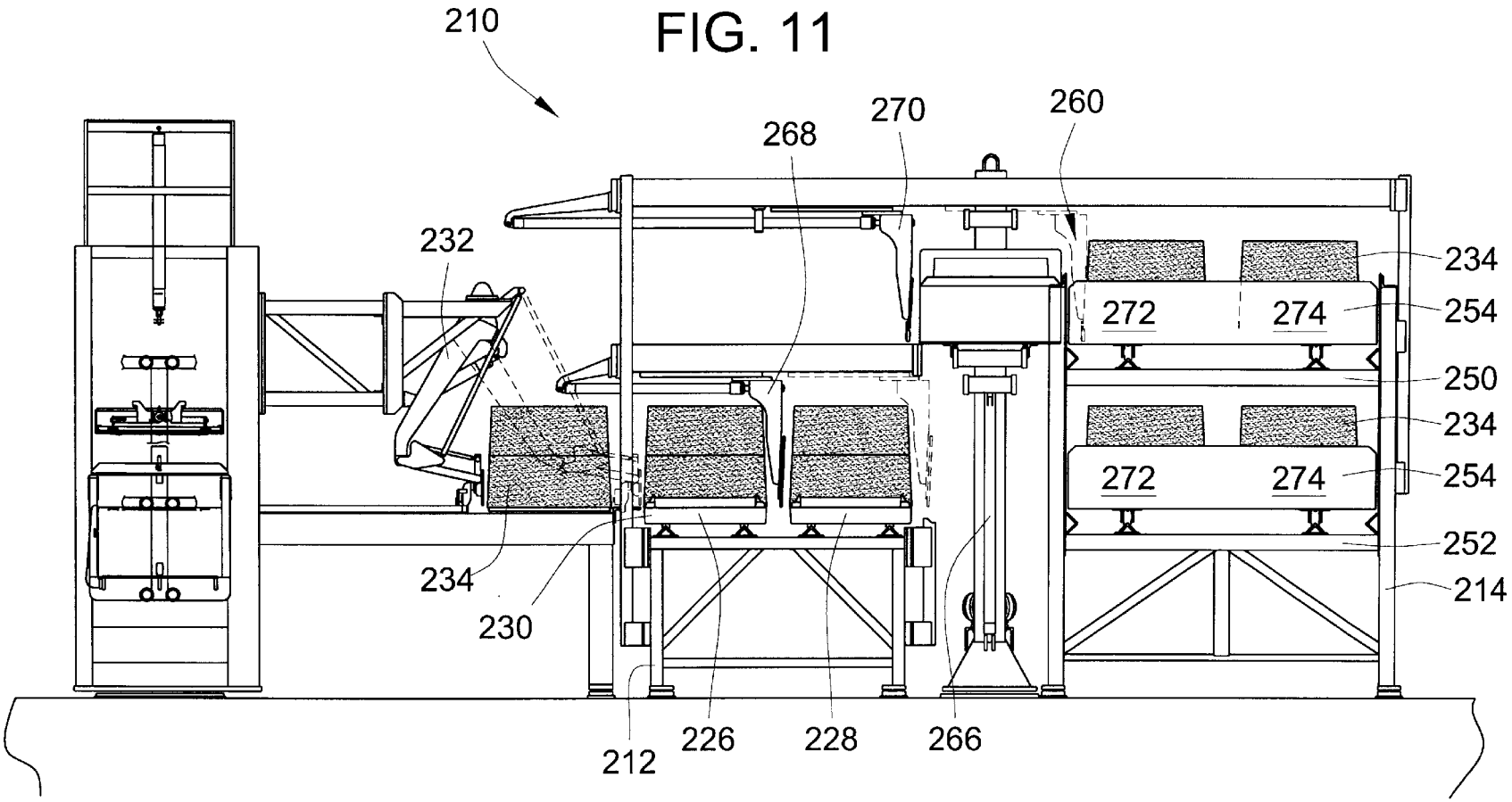
FIG. 11 is a cross section of FIG. 8 taken about line 11—11.

The one tiered pouring conveyor 212 includes first and second horizontally adjacent linear tracks 226, 228. The tracks 226, 228 extend parallel with each other and are situated and the same elevation as shown in FIGS. 10–11. A plurality of pouring pallets 230 are carried on the tracks 226, 228 for movement along and endless path around the tracks 226, 228. Hydraulically actuated lateral transfer mechanisms 236 are provided at the ends of the tracks 226, 228 to facilitate movement of the mold pallets around the tracks 226, 228. The lateral transfer mechanisms 236 include a first hydraulic actuator 238 that indexes or shifts the molds pallets 230 parallel to the linear length of the tracks 226, 228, and a second hydraulic actuator 240 that indexes or shifts the mold pallets perpendicular to the linear length of the tracks 226, 228.

The first track 226 receives newly formed molds from the sand mold forming station 216. A hydraulically actuated pusher arm 232 pushes individual sand molds 234 onto mold individual pallets 230 near the beginning of the first track as shown in FIG. 11 (with dashed lines illustrating the movement of the pusher arm and mold). After molds 234 on the pallets 230 are indexed one position, the molds 234 receive a weight and jacket 242 at the weight and jacket installation station 218. Thereafter, the molds 234 are indexed through the pouring station 220 which comprises a predetermined span 244 of the length of the first track 226. At the pouring station 220, molten metal is manually poured into the sand molds 234 from a ladle. After metal has been poured, the molds 234 are continued to be indexed around the pouring conveyor 212 over a sufficient period of time to allow the molten metal to cool sufficiently to allow safe removal of the weight and jacket 242 at the weight and jacket removal station 222. The weight and jacket removal and installation stations 218, 222 are disposed directly adjacent and perpendicular relative to the length of the tracks 226, 228, such that gripper arms 246 may easily transfer and recycle weights and jackets 242 from the removal station 222 to the installation station 218 with a short linear movement.

After removal of the weights and jackets 242, molds 234 are then laterally transferred from the one tiered pouring conveyor 212 to the two tiered cooling conveyor 214. Before explaining how transfer is effected, detail will first be had to the structure of the two tiered cooling conveyor 214. The cooling conveyor 214 includes an upper track 250 and a lower track 252 disposed at a lower elevation than the upper track 250. The tracks 250, 252 carry a plurality of mold holding pallets in the form of trays 254. Elevator mechanisms 256 at the ends of the tracks 250, 252 index and rotate the trays 254 around the upper and lower tracks 250, 252. The elevator mechanisms 256 raise and lower the trays 254 between tracks 250, 252 and include horizontal hydraulic rams 258 that impart horizontal motion to the trays 254 to move the sand molds 234 incrementally along the endless path of the upper and lower tracks 250, 252.

The upper track 250 of the two tiered cooling conveyor 214 preferably includes a mold inlet 260 for receiving molds from the pouring conveyor 212 and a mold outlet 262 for discharging molds to the discharge conveyor 224 for harvest of metal castings contained in the molds 234. By providing the inlet 260 and outlet 262 on the upper track 250, shifting molds 234 laterally on the cooling conveyor 214 can be advantageously effected from above the cooling conveyor 214 rather than between tracks 250, 252, thereby minimizing distance therebetween. The sand molds 234 also have a farther distance to fall to the discharge conveyor 224 which facilitates better and quicker break up of the sand molds 234.

Figure 9:
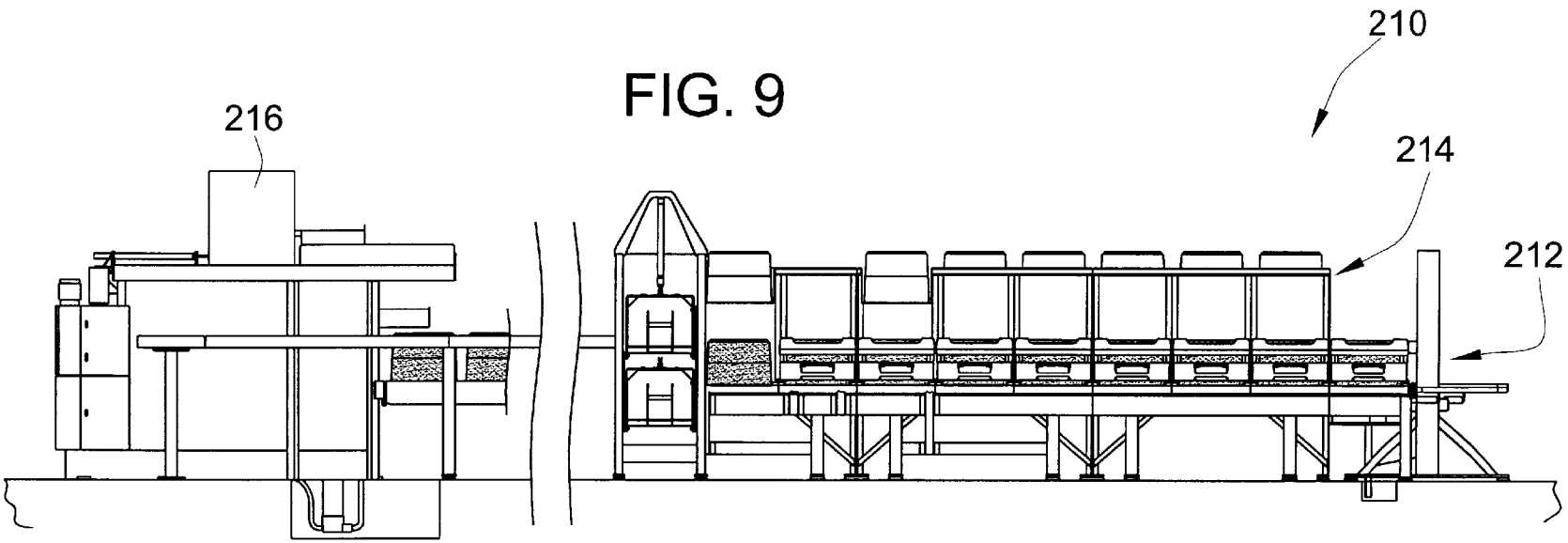
FIG. 9 is a side elevation view of the mold handling system illustrated in FIG. 8.
Figure 12:
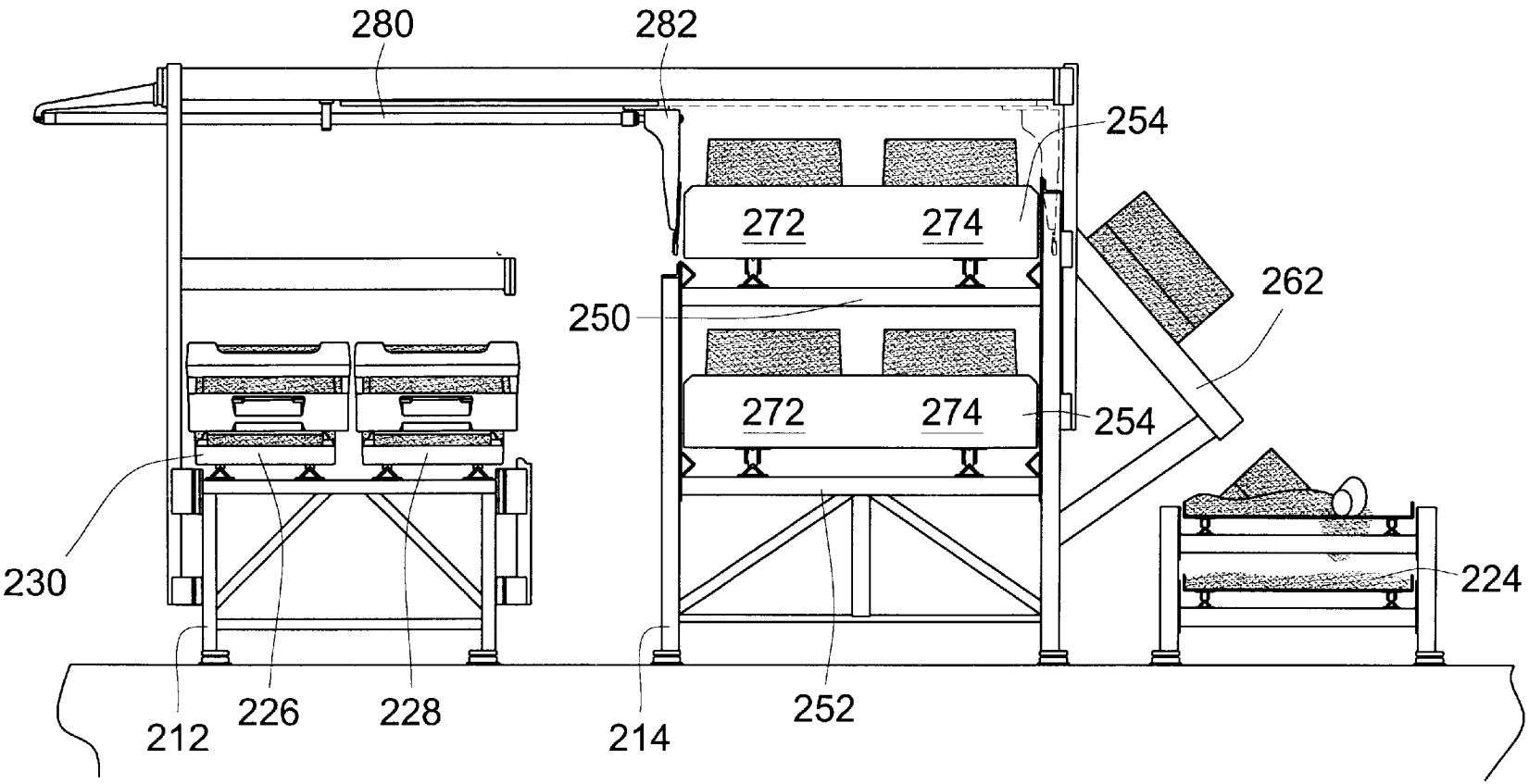
FIG. 12 is a cross section of FIG. 8 taken about line 12—12.

In viewing FIGS. 9, 11 and 12, it can be seen that the tracks 226, 228 of the pouring conveyor 212 are disposed at a lower elevation than the upper track 250 of the cooling conveyor 214 where molds 234 are received through the mold inlet 260. To transfer molds 234 from the pouring conveyor 212 to the cooling conveyor 214, the disclosed embodiment includes a transfer mechanism that comprises an elevator 266 and two hydraulically actuated pushers 268, 270. The first hydraulically actuated pusher 268 pushes individual molds 234 off of the pouring pallets 230 and onto the elevator 266. The elevator 266 raises individual molds 234 to the elevation of the upper track 250 in front of the mold inlet 260. The second hydraulically actuated pusher 270 pushes the individual molds 234 off the elevator 266, through the mold inlet 260 and onto trays 254 carried on the upper track 250. Both pushers 268, 270 are disposed in the same plane perpendicular to tracks of the pouring and cooling conveyors 212, 214. The first pusher 268 is mounted only over the pouring conveyor 212 so not as to interfere with the operation of the elevator 266. The second pusher 268 is mounted over the first pusher 268 and over the top of both conveyors 212, 214.

The disclosed embodiment also provides mold pallets or trays 254 that each include at least two adjacent mold receiving locations 272, 274, each mold receiving location being at least one mold wide, such that each tray 254 is adapted to receive and carry at least two sand molds 234 side by side. The number of mold receiving locations for each tray 254 depends upon the desired cooling dwell time for sand molds 234, which in turn primarily depends on the type of metal being poured and cast. For example three or more mold receiving locations can be provided if desired (similar to that shown in FIG. 7). By providing at least two mold receiving locations 272, 274, molds 234 of several trays are aligned into parallel in columns 276, 278. To provide for parallel movement, the first mold 234 entering an empty tray at the inlet 260 is pushed to the distal second location 274 and then shortly thereafter (and prior to indexing trays) the second mold 234 through the inlet is pushed only to the proximate first location 272. After both locations 272, 274 are filled, the trays 254 can be indexed.

To facilitate indexing of molds 234 across columns 276, 278, the disclosed embodiment includes a hydraulic indexing ram 280 that shifts individual molds across the trays 254. The hydraulic indexing ram 280 reciprocates perpendicularly relative to the length of the upper track 250 of the cooling conveyor 214. The hydraulic indexing ram 280 drives a pusher 282 that shifts individual molds 234 from the first receiving location 272 and second receiving location 274 on trays 254 in a single movement through the mold outlet 262 down a slide to the discharge conveyor 224. As such, the hydraulic indexing ram 280 is aligned with the mold outlet 262.

The hydraulic indexing ram 280 is located upstream of the second hydraulic pusher 270 that pushes new molds 234 into the first and second receiving locations 272, 274. The reason for this is that the hydraulic indexing ram 280 leaves the receiving locations 272, 274 open or free of sand molds 234 which in turn is filled by molds indexed onto the cooling conveyor 214 by the second hydraulic pusher 270. To provide clearance for the mold weight and jacket installation and removal stations 218, 222, and the gripper arms 246 thereof, the weight and jacket installation and removal stations 218, 222 are interposed horizontally between the hydraulic indexing ram 280 and the second hydraulic pusher 270.

It is an advantage of the fourth embodiment disclosed in FIGS. 8–12 that the system 210 can be more readily used to accommodate taller molds. In particular, pouring operations can be done at a lower level on the pouring conveyor 212. While providing for lower pouring, this embodiment also allows provides the advantage of entry and discharge of molds along the upper track 250 of the cooling conveyor 214.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A mold handling system for use in a sand mold casting machine having a mechanism for producing a plurality of sand molds, a mechanism for pouring molten material into the sand molds to form castings, and a mechanism for removing the sand from cooled castings, the mold handling system comprising:

a two-tiered conveyor interposed between the mechanism for producing a plurality of sand molds and the mechanism for removing the sand from the cooled castings, the two-tiered conveyor having an upper linear track and a lower linear track, the lower linear track disposed at a lower vertical elevation relative to the upper linear track;

a plurality of mold pallets carried on the upper and lower linear tracks along an endless path about the upper and lower linear tracks;

a mold inlet on the upper track for receiving molds on to the two tiered conveyor; and a mold outlet on the upper track for transferring molds off of the two tiered conveyor toward the mechanism for removing the sand from cooled castings.

2. The mold handling system of claim 1 wherein each mold pallet has a plurality of adjacent mold receiving locations such that each mold pallet is adapted to receive at least two sand molds side by side.

3. The mold handling system of claim 2 further comprising at least one indexing ram shifting molds on the mold pallets across the plurality of mold receiving locations perpendicularly relative to the linear length of the upper and lower tracks.

4. The mold handling system of claim 2 wherein the mold inlet is disposed at least one mold pallet in front of the mold outlet along the endless path, further comprising a first indexing ram aligned with the mold outlet for pushing molds through the mold outlet, and a second indexing ram aligned with the mold inlet adapted to push molds into the mold inlet.

5. The mold handling system of claim 2 wherein the mold pallets have at least three mold receiving locations.

6. The mold handling system of claim 1 wherein the lower track is disposed completely underneath the upper track.

7. The mold handling system of claim 1 further comprising a one tiered pouring conveyor interposed between the two tiered conveyor and the mechanism for producing a plurality of sand molds, the mechanism for pouring molten material into the sand molds to form castings being disposed along a span of the one tiered pouring conveyor, the one tiered pouring conveyor being disposed at a lower elevation relative to the upper track along said span.

8. The mold handling system of claim 7 further comprising an elevator between the pouring conveyor and the two tiered conveyor, the elevator elevating molds from the one tiered pouring conveyor to the mold inlet of the upper track of the two tiered conveyor.

9. The mold handling system of claim 8, wherein the pouring conveyor includes a first and second tracks, the first and second tracks extending linearly in parallel and horizontally adjacent relation, further comprising lateral transfer mechanisms at the ends of the first and second tracks adapted to transfer molds between the first and second tracks.

10. The mold handling system of claim 9, further comprising a weight and jacket installation and removal mechanism adapted to install weights and jackets on molds at first location on the first track and remove weights and jackets from molds at a second location on the second track, the second location being located adjacent the first location and perpendicularly from the first location relative to the linear length of the first and second tracks.

11. The mold handling system of claim 10 wherein the mold inlet is disposed at least one mold pallet in front of the mold outlet along the endless path, further comprising:

a first indexing ram aligned with the mold outlet for pushing molds through the mold outlet;

a second indexing ram aligned with the mold inlet adapted to push molds into the mold inlet; and wherein the weight and jacket installation and removal mechanism is interposed horizontally between the first and second indexing rams.

12. The mold handling system of claim 1 wherein the mechanism for pouring molten material into the sand molds to form castings is disposed along the two-tiered conveyor, wherein metal is poured into molds carried on the two-tiered conveyor, further comprising a weight and jacket installation and removal mechanism disposed along the two tiered conveyor, the weight and jacket installation and removal mechanism installing weights and jackets on molds on a first mold pallet on the upper track and remove weights and jackets from molds on a second mold pallet on the upper track, the second mold pallet disposed behind the first mold pallet.

13. The mold handling system of claim 12 further comprising means on the mold pallets at one of the receiving locations for supporting weights and jackets.

14. The mold handling system of claim 1 further comprising first and second elevators at the ends of the upper and lower tracks, the elevators moving mold pallets between the upper and the lower tracks.

15. The mold handling system of claim 14 wherein the first and second elevators include rams adapted to horizontal motion to the sand molds to move the sand molds incrementally along the endless path of the upper and lower tracks.

16. A method of indexing molds in a mold handling system, comprising:

carrying a plurality of sand molds on upper and lower tracks of a two tiered conveyor;

cycling sand molds aligned in a first column around a first loop around the upper and lower tracks;

cycling sand molds aligned a second column in a second loop around the upper and lower tracks, said second column parallel to the first column; and pushing molds perpendicularly relative to the first and second columns to provide for entry and exit of molds from the two tiered conveyor.

17. The method of claim 16 further comprising:

inputting new sand molds onto the upper track of the two tiered conveyor.

18. The method of claim 17 further comprising:

outputting cooled sand molds off of the upper track of the two tiered conveyor.

19. The method of claim 18 wherein the inputting step takes place after the outputting step and in spaced relation relative to the outputting step on the two tiered conveyor.

20. The method of claim 17 further comprising:

pouring molten metal into sand molds at a first elevation on a pouring conveyor adjacent the two tiered conveyor;

elevating the molds from the pouring conveyor to the top track of the two tiered conveyor, said inputting being done after said elevating.

* * * * *